United States Patent [19]

Grimes et al.

[11] Patent Number: 4,525,177

[45] Date of Patent: Jun. 25, 1985

[54] METHOD OF MAKING COATED ABRASIVE DISC

[76] Inventors: Philip M. Grimes, 15 McMurrich St., Toronto, Ontario, Canada, M5R 3M6; John R. Grimes, 33 Harbour Sq., Toronto, Ontario, Canada, M5J 2G2

[21] Appl. No.: 471,698

[22] Filed: Mar. 3, 1983

[51] Int. Cl.[3] ..... B24D 11/00

[52] U.S. Cl. ..... 51/295; 51/298

[58] Field of Search ..... 51/295, 298

[56] References Cited

U.S. PATENT DOCUMENTS

| | | | |
|---|---|---|---|
| 3,116,574 | 1/1964 | Ciesielski | 51/295 |
| 3,136,614 | 6/1964 | Kuzmick | 51/298 |
| 3,166,388 | 1/1965 | Riegger et al. | 51/298 |
| 3,208,837 | 9/1965 | Shatto | 51/295 |
| 3,551,125 | 12/1970 | Hallewell | 51/298 |
| 3,800,483 | 4/1974 | Sherman | 51/298 |
| 4,088,729 | 5/1978 | Sherman | 51/298 |
| 4,099,934 | 7/1978 | Suzuki et al. | 51/295 |

*Primary Examiner*—Paul Lieberman
*Assistant Examiner*—Willie Thompson
*Attorney, Agent, or Firm*—Fetherstonhaugh & Co.

[57] ABSTRACT

The invention is a coated abrasive grinding disk for mounting in the chuck of a drill or the like wherein the grinding pad is of a thermoplastic material having a layer of abrasive material bonded thereto with a layer of thermosetting plastics material.

3 Claims, 6 Drawing Figures

METHOD OF MAKING COATED ABRASIVE DISC

This invention relates to a coated abrasive disc for use in a chuck of a grinding tool in the abrasive finishing of articles of manufacture.

The disc is used, for example, in the finish sanding of metal, wood and plastics manufactured parts that require finishing by smoothing after a welding, molding or other manufacturing operation.

The abrasives industry supplies enormous quantities of grinding discs for this purpose and the grinding assembly has traditionally included a back-up pad made from a resilient material such as rubber or plastics suitably reinforced, a grinding disc detachably mounted on the back-up pad and an associated mandrel for insertion into the chuck of a rotational grinding tool.

The present coated abrasive discs comprise a backing of sheet material such as paper, cloth, fibre or the like to which is applied a coating of an abrasive grit material. The discs are either mechanically or adhesively secured to the back-up pad and are readily replaceable in use. They are universally manufactured by the method of coating a backing sheet of paper, cloth, fibre or the like with an abrasive and then stamping the circular sanding disc from the sheet. The specification of the abrasive is, of course, determined by the sanding or grinding job to be done. As noted, enormous quantities of these discs are consumed in industries such as the aircraft industry where welded joints, molded parts, rivet heads and the like must be made smooth. They are also used in the fiberglass molding industry where joints and molding contours must be smoothed and in metal working industries such as automobile aircraft, munitions where welded joints and metal parts must be made smooth. Apart from the means for detachably mounting the coated abrasive discs on the back-up pads there has been no change in the design of the device for as long as most of the present users of the device can remember and it is thought that the general construction of the device has always been of this nature.

There are limitations to the utility of the present design arrangement and one of them is that the discs cannot be used effectively for a grinding operation substantially at right angles to the general plane of the disc. For example, they cannot be used to extend the depth of or effectivley clean out a groove. If this is attempted to any extent the disc wears at its edge and ruptures exposing the back-up pad with the result that the back-up pad also ruptures or tears.

A coated abrasive disc according to this invention is capable of grinding a groove formation wherein the edge of the disc is urged into the workpiece substantially at 90 degrees to its principal face without rupture of the assembly at its peripheral margin. The result is achieved by providing a back-up pad to which a layer of abrasive material has been directly adhered. The back-up pad is of a molded thermoplastics material which disintegrates as edge grinding proceeds at the rate that the abrasive material is consumed. The heat of the grinding operation causes the backing to disintegrate and disappear at a rate commensurate with the using up of the abrasive material by the edge grinding operation. Thus, the backing disappears as it is used up but there is no fraying that leads to rupture of a back-up pad as a whole as is the case with the present use on coated abrasives grinding tools.

Grinding at a right angle is, by no means, the only kind of grinding that is commonly performed by these grinding devices. In fact, the more common kind of grinding is the parallel kind of grinding wherein the grinding face of the disc is substantially parallel to the surface to be smoothed or ground. The grinding efficiency of a grinding disc according to this invention is relatively high and on the basis of tests made it is at least as good and in some cases better than the grinding efficiency of conventional grinding pads wherein the abrasive coated disc is secured to an independently formed resilient back-up pad.

The invention eliminates the resilient back-up pad conventionally made from rubber or plastic or a reinforced rubber-like material and avoids the difficulties of early disintegration or rupture of the pad in the case of edge grinding. It also achieves a construction that, in many cases, has been shown to have an improved efficiency in normal grinding. It is, moreover, economical to manufacture.

A finishing coated abrasive grinding disc for attachment to a power source according to this invention comprises a resilient back-up pad of a molded thermoplastics material, said resilient back-up pad having strength to transmit grinding force to a workpiece in use and also having an abrading face, a layer of abrasive material bound to said face of said resilient back-up pad, said external layer of abrasive grit material being bound to said abrading face of said resilient back-up pad with a thermo setting plastics resin that adhesively fuses with the thermoplastics material of the resilient support backing. The invention will be more clearly understood after reference to the following detailed specification read in conjunction with the drawings.

Figure 5:
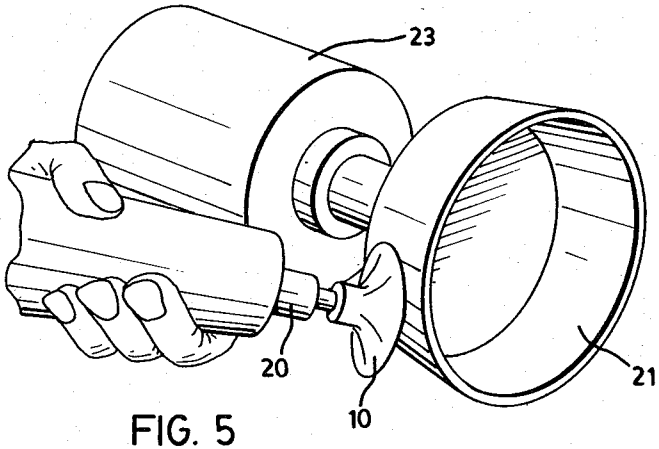
FIG. 5 is an illustration of a parallel grinding operation with the disk.

Referring to the drawings, the numeral 10 generally refers to a finishing coated abrasive grinding disc according to this invention. It has a resilient back-up pad with a round resilient surface 12 to which an abrasive material is adhesively fused and a hub 14 that is internally threaded as at 16 for securement to a shaft 18 that is mountable in the chuck of a grinding tool 20.

The back-up pad 12 and hub 14 are moulded from a thermoplastics material. An external layer of abrasive grit material 22 is fused to the outer face of the resilient support backing 12 with a thermosetting plastics binder that is adhesively compatible with the thermoplastics material of the resilient support backing 12. The thermosetting bonding material is indicated by the numeral 24.

The manner of using the disc is indicated in FIG. 5. Firstly, the grinding disc 10 is screw threaded to the shaft 18. The shaft 18 is then mounted into the chuck of a rotational grinding tool 20 of conventional design. In the case of FIG. 5 a wooden bowl 21 is mounted in a mandrel that extends from electric motor 23. The wooden bowl is rotated as the motor 23 is operated and the grinding tool 20 is operated to rotate the sanding disc 10 at a rate of about 15,000 rpm. The sanding disc is moved over the surface of the bowl to achieve the desired smoothing.

The required mechanical characteristics of the back-up pad 12 of the disc include at least some of the mechanical characteristics of the rubber back-up pad that is used with the removable coated abrasive discs of the prior art. More specifically, the resilient thermosetting plastics back-up pad must have resilience, but at the same time the strength to transmit the grinding force from the tool 20 as it is urged against the workpiece. It must be resilient to conform to the shape of the workpiece, but at the same time it must have strength to transmit a grinding force when pressed against the workpiece.

The thermoplastics material must also have a relatively high melting point to withstand the heat of the grinding friction encountered in substantially parallel grinding operations such as illustrated in FIG. 5. At the same time, it is part of the function of the back-up pad to disintegrate under the kind of more intense temperatures encountered with an edge grinding operation as will be explained later.

A further important characteristic of the thermoplastics material 12 of the back-up pad is that it has the ability to become compatible with and fuse to the thermosetting plastic resin that is used to bind the abrasive grit to the grinding surface of the back-up pad.

As indicated, the abrasive grit is bonded to the backup pad with a thermosetting resin of good thermo and chemical resistance that can be cured to achieve a hard, tough, thermofused state with high mechanical strength at elevated temperatures encountered in grindng and that is compatible with the thermoplastics material of the back-up pad as above noted.

The abrasive grinding media may be of any variety of natural or synthetic abrasive material such as diamonds, flint, emery, garnet, aluminum oxide, silicon carbide, alumina zirconia, ceramic aluminum oxide as required for the job to be done in accordance with standard abrasives practice.

It is not intended that the invention should be limited to the specific thermoplastics and/or thermosetting plastic material because the invention is not the selection of specific materials, but rather the combination of these kinds of material in a mechanical assembly. It has been found that polyamides appropriately reinforced are commercially available with appropriate characteristics for molding the back-up pad and that phenolic resins appropriately combined with fillers constitute a satisfactory thermosetting plastis resin for combination with a polyamide material. Selection of an appropriate polyamide base resin and phenolic resin having regard to the principles of selection outlined herein would be apparent to a person skilled in the art.

Figure 6:
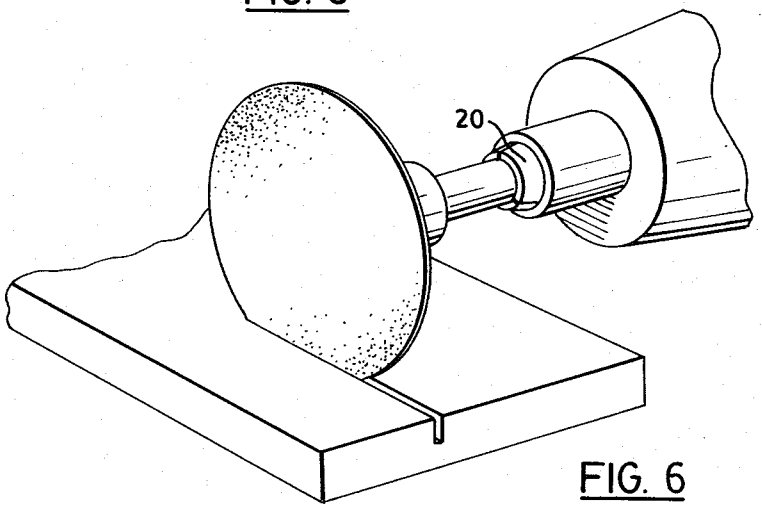
FIG. 6 is an illustration of an edge or 90 degree grinding operation with the disk.

There is often a requirement for discs of this nature to do edge grinding as illustrated in FIG. 6; to grind in a groove or even to form a groove in a work piece.

The disc according to this invention is able to cut notches in angle iron as illustrated in FIG. 6. As the cutting continues the diameter of the disc is reduced. The reduction occurs as the abrasive grit and thermosetting resin are worn away by the grinding action. The thermoplastics backing material disintegrates under the local intense heat so that as the grinding proceedes the diameter of the disc is gradually reduced at a rate determined by the using up of the abrasive. The grinding disc continues to be effective as a grinding disc that is reduced in diameter. No commercially available coated abrasive grinding disc is capable of this kind of service. When attempted the abrasive at the edge of the disc wears quickly and the separately formed rubber back-up pad for the disc then becomes torn and useless.

The added utility of being able to edge grind indefinitely at an angle of substantially 90 degrees to the face of the disc without destroying the flexible back-up pad for the grinding assembly is a very important advance in the art. It is achieved through the provision of the thermoplastics material of the resilient back-up pad and the directly fused abrasive surface. As the abrasive and thermosetting resin which binds the abrasive to the thermoplastics back wears, due to the grinding operation, the thermoplastics backing disintegrates.

With the assemblies of the prior art the backing material is of a rubber or plastic and as the abrasive is worn away at the edge in an end grinding operation the rubber behind the abrasive that under normal operation supports the abrasive is subjected to the direct contact with the work piece. It tears and rips the rubber backing so that within a very short period of time the whole disc is useless.

In use there are also grinding applications wherein a disc of smaller diameter than is available is required. The disc might be required for a parallel type of grinding. In such a case one can reduce the size of an available disc to the size required by operating it in an edge grinding mode to reduce its diameter to that required for a custom parallel type of grinding operation.

To manufacture the grinding disc one first molds the support backing assembly 10. One then applies the resin coated abrasive grit to bond it to the grinding face of the support backing. After application of the grit the thermosetting bonding resin is cured by heat process.

In order to keep the support backing assembly from warping during the curing process, it has been found necessary to support it on a fibrous substrate backing 27 such as pressed wood. In this latter respect it will be noted that the wood substrate is formed with a depression to receive the hub of the moulding and a threaded bolt 26 is tightened to hold the resilient back-up pad firmly against the substrate during the curing process. The substrate support acts as an insulating material and prevents rapid transfer of heat through the resilient support backing during the curing process.

Following is an example of a manufacture of an abrasive grinding disc according to the invention.

A resilient back-up pad in the form of a 3 inch disc with a $\frac{1}{4}$ inch center hole was cut from a sheet of polyamide thermoplastic 40% mineral reinforced material. The material was produced by Dupont and is identified as Minlonn 11C-40 and has the required mechanical properties.

The abrasive grit was applied to the back-up with a phenol formaldehyde type of resin manufactured by the Reichold Chemical Company and identified as Reichold Resin No. 29368 mixed with a 30% calcium carbonate to reduce viscosity to 400 centipois at 20 degrees Centigrade.

Figure 2:
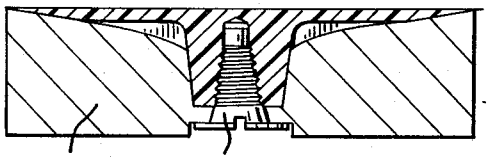
FIG. 2 is a similar view of the disc mounted in a pressed wood support within which its outer face is coated with an abrasive and cured in the disc manufacturing process.

The disc was secured by means of a metal screw and a nut to a pressed wood form similar to the form indicated in FIG. 2. It will be understood that the disc of this example does not have a hub 14 and in use will have to be secured by a washer and bolt to the mounting shaft that attaches to the chuck of the grinding machine.

Figure 4:
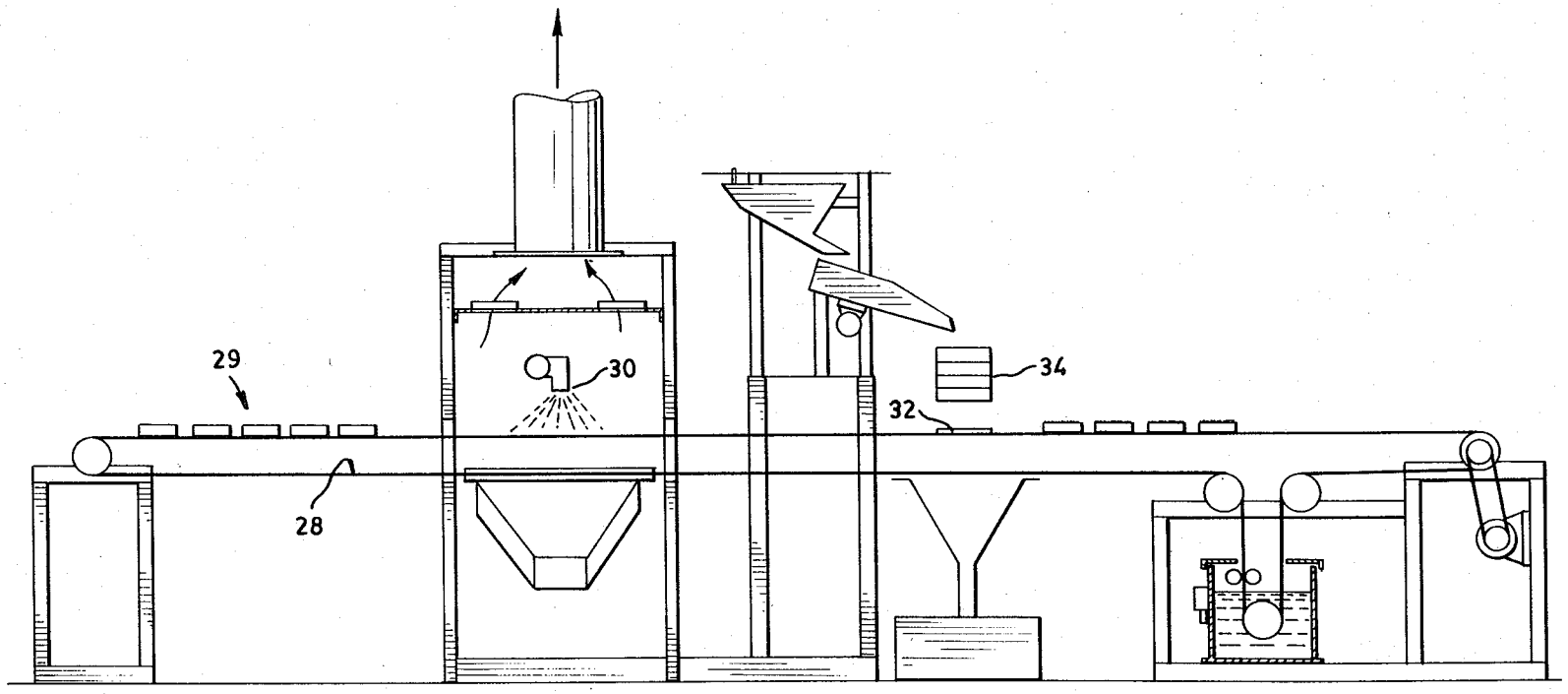
FIG. 4 is a schematic illustration of the manner of manufacturing the disk.

The mounted disc was processed in a production line similar to the one illustrated in FIG. 4. The disks, mounted on pressed wood supports like the support 10 and generally indicated by the numeral 29, were conveyed on a conveyor belt 28 under the spray nozzle 30 to receive a coating of the phenolic resin calcium carbonate mixture to a density of 0.0201 grams per square centimeter.

As they proceeded along the conveyor line, they received a coating of electrostaticly charged abrasive grain as at numeral 32. The grain is according to standard coating practice charged through charging screens 34 in order to separate the particles one from the other as they are applied to the surface.

The abrasive grain used was 60 grit alumina zirconia manufactured by the Norton Company and sold under the trade mark NORZON. The grain was applied to achieve a coating density of 0.0500 grams per square centimeter.

The coated discs were then dried in an oven for one hour at 95 degrees centigrade.

A sizing coat of thermosetting resin was then applied by repassing the coated discs under the resin applying head 30. The sizing coating was a mixture of 50 parts resin Reichold 29368, 50 parts calcium carbonate and with the viscosity adjusted to 375 centipois at 20 degrees centigrade. A coating weight of 0.0241 grams per square centimeter was applied.

The thusly coated article was dried for one hour at 95 degrees centigrade and cured for 2½ hours at 105 degrees centigrade. Following the cure the disc was immersed in room temperature water for 24 hours.

The disc so constructed was tested by mounting it on the end of a rotating shaft in a grinding tool and rotated at 23,000 r.p.m. The grinding efficiency was rated at 73 grams of angle iron stock removed per minute of grinding.

Following is a second example of a disc according to the invention. A resilient support disc was cut as in Example 1. The thermosetting plastics binder in this case was a Reichold resin identified as No. 29353. It is a commercially available phenol formaldehyde phenolic resin. It was mixed with 30% calcium carbonate to reduce viscosity to 400 centipois at 20 degrees centigrade. The disc was processed as above described and coated with the resin mix at a rate of 0.0201 grams per square centimeter, followed by an electrostatic coating of abrasive grit of 0.0562 grams per square centimeter of 60 grit aluminum oxide graded for normal coated abrasive applications. The coated article was dried for one hour at 95 degrees centigrade and coated for a second time with a mixture of fifty parts Reichold resin 29353 and 50 parts calcium carbonate adjusted to a viscosity of 375 centipois as a size coat of 0.0241 grams of resin mix per square centimeter. The article was dried for one hour at 95 degrees centigrade and cured for 2½ hours at 105 degrees centigrade. Following the cure the disc was emersed in room temperature water for 24 hours.

The finished product was tested by grinding with a Black and Decker air tool at 23,000 r.p.m. The grinding efficiency was rated at 35 grams of angle iron stock removal per minute of grinding. A commercially available disc of conventional manufacture with similar abrasive and separate rubber back-up pad was tested in the same circumstances and achieved an efficiency of 30 grams of angle iron stock per minute of grinding. Thus, the grinding efficiency of the disc made in accordance with this invention was 16.5% superior to the grinding efficiency of a conventional disc with similar abrasive Following is a specification of a third abrasive grinding disc according to this invention. In this case, a three inch resilient support backing pad was molded with the cross section of backing 12 of FIG. 1 using a polyamide thermoplastic material commonly known as Nylon 6/6.

The thermosetting plastics binder was a mixture of Reichold resin No. 29368 which is a phenol formaldehyde phenolic resin made commercially available through the Reichold company, mixed with 30% calcium carbonate and reduced to a viscosity of 400 centipois. The phenolic resin spray at head 30 was at a density of 0.0120 grams of wet adhesive per square centimeter. Aluminum oxide abrasive grain of 120 grit size was applied at the electrostatic charged screens 34 to a density of 0.0301 grams per square centimeter.

The thusly coated disc was predried for one hour at 95 degrees centigrade and a top coating of a mixture of 50 parts of the same phenolic resin and 50 parts of calcium carbonate adjusted to 375 centipois at 20 degrees centigrade was applied to the abrasive grain as a size coat at a rate of 0.0181 grams per square centimeter.

The disc was then dried for one hour at 95 degrees centigrade and cured for 2½ hours at 105 degrees centigrade.

The disc was then removed from its mounting block and the finished product was mounted on the shaft and tested in a 6152 Black & Decker air sander at 23,000 rpm. The disc was mounted in the sander and tested in a grinding operation on angle iron. The efficiency of the disc was rated at 12 grams of stock removal per minute, in a test where the grinding operation was continuous for 15 minutes. At the completion of the 15 minute test the disc was still capable of removing between 10 and 12 grams of stock per minute of grinding.

A commercially available disc and employing a similar abrasive under a 10 minute test removed about 11.5 grams of stock per minute.

Figure 1:
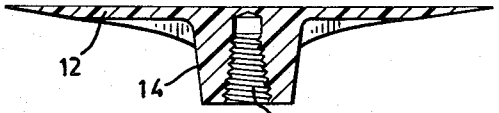
FIG. 1 is a cross-sectional view of a moulded back-up pad with integral mounting hub of an abrasive grinding disk.
Figure 3:
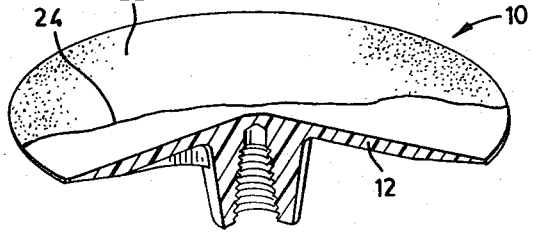
FIG. 3 is a perspective illustration of the manufactured grinding disc about to be screw mounted on a shaft which, in turn, is mounted in the chuck of a rotational power tool for use.
Figure 3:
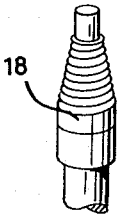

Embodiments of the invention other than those described will be apparent to those skilled in the art. The examples of thermoplastics and thermosetting resins that have been given are not intended to be given in a limiting sense. The mechanical detail of the disc can vary. In FIGS. 1 to 3 the backing and the structure for securing the backing to a shaft are integrally moulded. This need not be the case and, in fact, in the specific examples of discs that were manufactured the resilient support surface was merely stamped from a sheet of thermoplastics material and then screw threaded to a shaft of a grinding machine.

The important thing is that the abrasive grit be set in a thermosetting resin backed by a thermoplastic resin. The grit should be maintained by a resin that has assumed a permanent set under heat. The backing, on the other hand, should be thermoplastic, but, of course, of sufficient resilience and strength to function as a sanding disc under conditions of use. Selection of an appropriate resin to perform the required function is a matter of skill in the art.

What we claim as our invention is:

1. A method of making a coated abrasive grinding disc with a resilient thermoplastics material back-up pad comprising the steps of:

making a back-up pad of a resilient moulded thermoplastics material that has resilience to yield to the contour of a workpiece and strength to transmit grinding force to a workpiece in use;

said back-up pad having a work face;

supporting the back-up pad on a support disc that resists warping under conditions of heat encountered in plastics curing with the work face of the pad exposed, and applying a holding force to secure the back-up pad on the support disc to resist warping;

applying a layer of thermosetting adhesive to the work face of the disc;

applying a layer of abrasive grit into the adhesive;

drying the adhesive at an elevated temperature;

applying a sizing coat of thermosetting adhesive over the abrasive grit; and curing the thermosetting adhesive at an elevated temperature.

2. A method of making a coated abrasive grinding disc as claimed in claim 1 wherein after curing the disc is emersed in room temperature water for conditioning.

3. A method of making a coated abrasive grinding disc as claimed in claim 1 wherein the back-up pad is moulded substantially from a polyamide thermoplastic base moulding resin and said abrasive binder consisting substantially of thermosetting resin of a phenolic resin base.

* * * * *